US009080735B1

(12) United States Patent
Cameron et al.

(10) Patent No.: US 9,080,735 B1
(45) Date of Patent: Jul. 14, 2015

(54) SAFETY AND SIGNALING FLASHLIGHT

(71) Applicants: Robert W Cameron, Bend, OR (US); Greg Kleinert, Bend, OR (US)

(72) Inventors: Robert W Cameron, Bend, OR (US); Greg Kleinert, Bend, OR (US)

( * ) Notice: Subject to any disclaimer, the term of this patent is extended or adjusted under 35 U.S.C. 154(b) by 0 days.

(21) Appl. No.: 14/322,751

(22) Filed: Jul. 2, 2014

Related U.S. Application Data

(60) Provisional application No. 61/857,885, filed on Jul. 24, 2013.

(51) Int. Cl.
*F21L 4/02* (2006.01)
*F21Y 113/02* (2006.01)

(52) U.S. Cl.
CPC ..... *F21L 4/025* (2013.01); *F21Y 2113/02* (2013.01)

(58) Field of Classification Search
CPC ... F21V 19/04; F21V 23/0414; F21V 14/045; F21V 23/04; F21L 4/005; F21L 4/022; F21L 4/025; F21L 4/027; F21L 11/00; F21L 14/023; F21Y 2101/02; F21Y 2113/00; F21Y 2113/005; G08B 5/006; H05B 33/08
USPC ..... 362/20, 157, 183–188, 194, 197, 362/200–205, 208, 231, 232, 249.01, 362/249.02, 249.12, 249.13; 307/112, 113; 340/321, 331, 332, 815.4
See application file for complete search history.

(56) References Cited

U.S. PATENT DOCUMENTS

| | | | | |
|---|---|---|---|---|
| 3,579,100 | A * | 5/1971 | Lauver | 324/506 |
| 5,077,644 | A * | 12/1991 | Schaller et al. | 362/184 |
| 6,841,941 | B2 * | 1/2005 | Kim et al. | 315/86 |
| 7,214,952 | B2 * | 5/2007 | Klipstein et al. | 250/504 H |
| 2007/0153512 | A1 * | 7/2007 | Hendrie | 362/231 |
| 2008/0205036 | A1 * | 8/2008 | Tarter et al. | 362/105 |
| 2009/0189541 | A1 * | 7/2009 | Crawford et al. | 315/294 |
| 2013/0308308 | A1 * | 11/2013 | Pritchett | 362/184 |

* cited by examiner

*Primary Examiner* — Hargobind S Sawhney
(74) *Attorney, Agent, or Firm* — Roy L. Anderson; Wagner Anderson & Bright

(57) ABSTRACT

A flashlight includes three essentially separate flashlight modalities, with differing lighting profiles and redundant critical components, that operates from a single case that can be modified to make it especially well suited for use in a number of differing environments in which a safety and signaling flashlight can be life critical.

16 Claims, 3 Drawing Sheets

Fig. 1
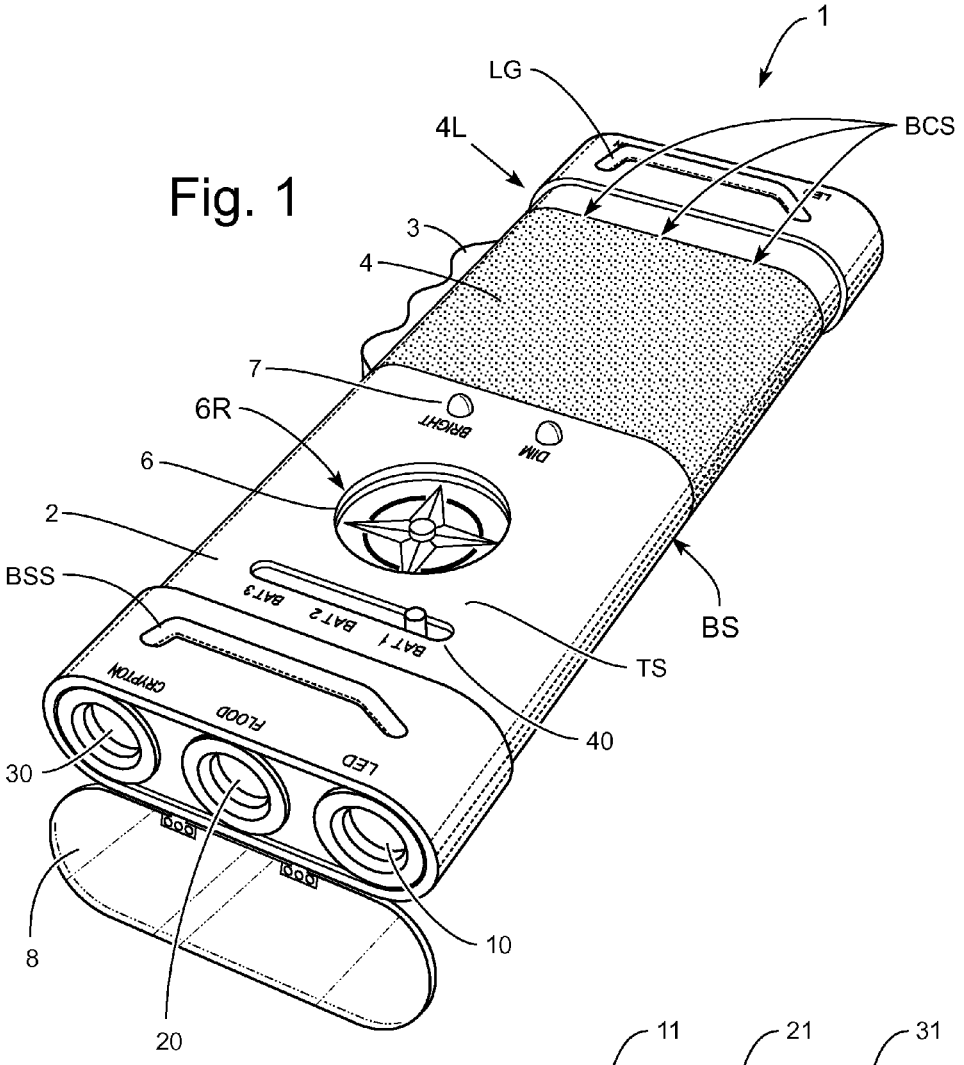
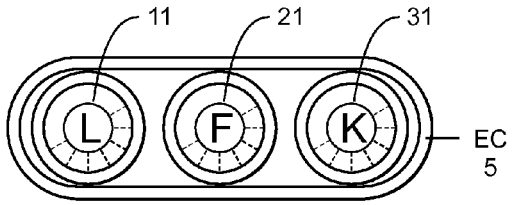
Fig. 1A

SAFETY AND SIGNALING FLASHLIGHT

CROSS-REFERENCE TO RELATED APPLICATIONS

This application is a non-provisional application that claims priority from U.S. Ser. No. 61/857,885, filed Jul. 24, 2013, the disclosure of which is specifically incorporated herein in its entirety.

FIELD OF THE INVENTION

The field of the invention is specialty flashlights used for safety and signaling.

BACKGROUND OF THE INVENTION

Flashlights are in common use and come in a variety of sizes, shapes, battery size and price ranges. The present invention is directed to a flashlight that is reliable and especially suited for situations where performance may be life critical and signaling may be a critical function.

SUMMARY OF THE INVENTION

The present invention is generally directed to a flashlight that, in essence, has three flashlight modalities within a single flashlight case. The flashlight according to the present invention has a single housing, preferably watertight and, optionally, explosion-proof, that houses three independent electrical systems activated by three on/off switches to power three bulbs from three different battery sources held within three battery compartments (which can be in a single cavity with separate sets of electrical contacts) so as to provide the ability to use three different flashlights modalities having differing characteristic lighting profiles (e.g., a low energy use LED bulb, a high energy focused light beam and a flood light).

The battery sources used in the present invention can be removed from their battery compartment and interchanged for use with the other flashlight modalities and/or a switch can be used to change which of the three battery sources is used with a given flashlight modality while one or more multi-mode functions switches can be used to operate a given bulb in different lighting modes (e.g., a dim mode, a bright mode and a blinking mode) while a signaling means can be used to provide a signaling color (e.g., red or green), an example of which is to position a colored lens in front of the flashlight' light bulbs.

In other aspects of the present invention, the case of the flashlight can be modified to include a compass, finger grips, a non-slip surface and a sleeve for holding a removable insert (e.g., a radiation badge).

Accordingly, it is an object of the present invention to provide an improved flashlight designed to be especially useful as a safety and signaling flashlight.

This and further objects and advantages will be apparent to those skilled in the art in connection with the drawings and the detailed description of the invention set forth below.

BRIEF DESCRIPTION OF THE DRAWINGS

FIG. 1 illustrates a preferred embodiment of the present invention while FIG. 1A illustrates an end view of the flashlight with its end cap removed.

FIG. 2 illustrates a different preferred embodiment of the present invention while

DETAILED DESCRIPTION OF THE INVENTION

Figure 2:
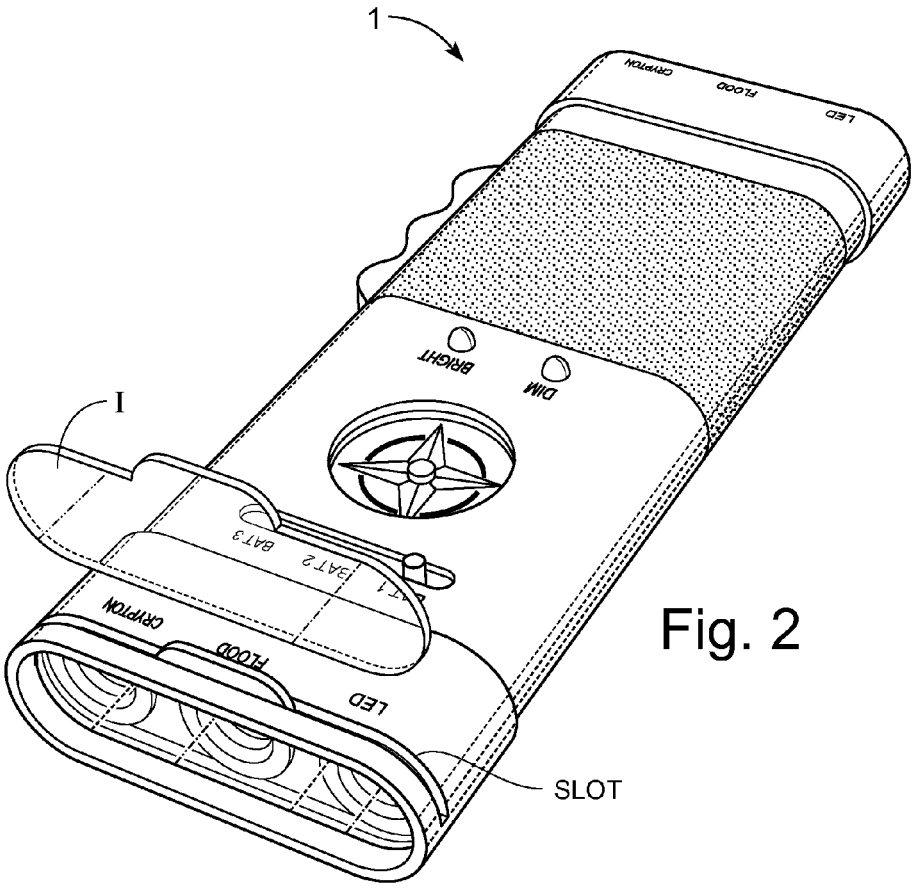
Figure 2A:
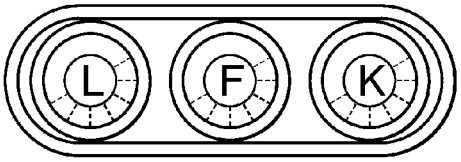
FIG. 2A illustrates its end view and FIG. 2B illustrates its reverse side.

The present invention is generally directed to a high-quality, high-durability safety and signaling flashlight, shown generally as 1. The flashlight combines three essentially separate flashlights into a rugged nylon glass-filled waterproof case 2. Each of the essentially three separate flashlights included within flashlight 1 has its own function, its own batteries, its own switch, and its own bulb. More specifically, flashlight 1 has an LED flashlight bulb 10, a flood bulb 20, and a krypton bulb 30, each of which has its own switch—11, 21 and 31, respectively—and each of which is separately powered by its own separate three AA batteries in a separate battery compartment slot BCS inside of flashlight 1, meaning that flashlight 1 will carry a total of nine AA batteries (or AAA batteries, in an alternative design). Because each of the three essentially separate flashlights has its own electrical system, should one of these flashlights fail, the others will not. Thus, for example, if one of the essentially separate flashlights should fail because its batteries are dead, batteries from one of the other essentially separate flashlights could be used to replace the dead batteries so the flashlight in question could continue in use, which is a huge advantage in many critical situations such as, for example, search and rescue.

LED bulb 10 offers certain advantages over flood bulb 20 and krypton bulb 30. For example, LED bulb 10 uses less energy and is more rugged than krypton bulb 30, but krypton bulb 30 has a higher level of lumens and functions better for concentrating beams of light on an area, so krypton bulb 30 can be designed for a more concentrated beam of light than LED flashlight bulb 10. In contrast to LED bulb 10 and krypton bulb 30, flood bulb 20 is designed to have a wide-angle, soft beam that is useful for going up a trail and for situations such as travel in snow when such a beam is more beneficial than that which can be obtained from LED bulb 10 or krypton bulb 30. In addition, while many flashlights have mechanisms for focusing their beams from spot to flood, by having fixed, specified functions, there is less to fail and it is easy to switch between functions and always get it right, without the need for focusing, by simply selecting the essentially separate flashlight that has the desired functionality for a given situation.

The switches for the three essentially separate flashlights, 11, 21 and 31, are located in an end cap EC of flashlight 1. Each of the switches, and all of the components of flashlight 1, in an especially preferred embodiment, are explosion-proof, so flashlight 1 can be used in marine situations where an explosive flashlight might be ignited by a traditional flashlight. It is desirable for switches 11, 21 and 31 to have o-rings to keep the inner compartment of flashlight 1 both watertight and explosion-proof. The switches can be of a push-bottom type or, preferably, require a twist to turn them on and off (such as twisting left to turn on, right to turn off), the latter being preferred since it is less likely to be accidently actuated. Note that while FIG. 1 also includes a thumb-slide switch 40 for selecting between the three essentially separate flashlights, such a switch is optional and need not be included, or it might be used if a single activation switch is used in end cap EC.

Case 2 has ergonomic finger grip edges 3 formed into it along with a non-slip textured surface 3 that wraps around the case so that it encompasses 270 degrees of the flashlight apart from finger grip edges 3. A lanyard grip LG can be conveniently located beneath finger grip edges 4 and an end-cap area containing switches 11, 21 and 31. Case 2 is shown in FIG. 1 as having a Brunton® liquid-filled compass 6 in a top surface TS which can be included as part of the standard flashlight 1 or be inserted, optionally, in a compass recess 6R designed for later addition of such a compass. On the bottom surface BS of case 2 opposite of compass 6 a smooth surface can be left for mounting a radiation stamp as a standard or optional feature (see FIG. 2B), or a living hinge or slot 50 or other attachment mechanism can be built into bottom surface BS to hold a radiation stamp 51. One or more control switches 7 are built into case 2 for controlling certain functions of 1 or more of the flashlights contained within flashlight 1, and FIG. 1 illustrates two such switches as being a bright function and a dim function, and an additional function that can be added is a strobe or blinking function, which might have its own switch (not shown in FIG. 1).

Figure 2B:
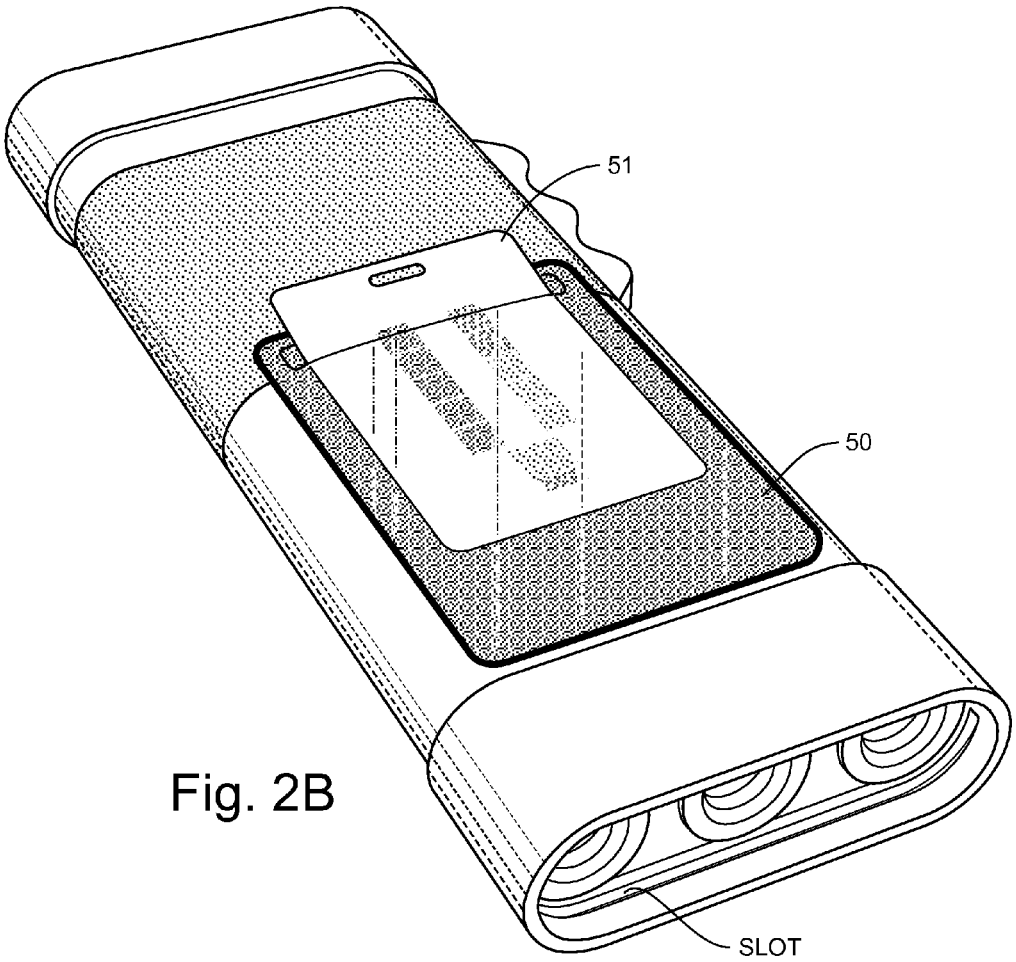

It is sometimes important and useful for flashlight 1 to use a colored lens, such as green or red, for signaling. A colored lens can be added to flashlight 1 in a number of ways, FIG. 1 illustrating a flip-up lens 8 while FIG. 2 illustrates different color inserts I that can be inserted into a slot of the flashlight. Instead of using a flip-up lens, flashlight 1 can be fitted with a lens cap holder with a colored lens designed to mount over bulbs 11, 21 and 31, or holder 2 can be designed to include a slot for holding a colored lens, or other methods of mounting a colored lens over bulbs 11, 21 and 31 can be used.

The resulting flashlight described herein offers many advantages over existing flashlights and is extremely rugged and durable, suited to professional use in search and rescue, and for use by professionals (e.g., fireman) and persons that require a dependable flashlight for use in multiple applications where failure should not be an option and lives may be on the line. It is also easy to hold and grip, and designed for use in many environments, such as where an explosion-proof flashlight is required.

While the invention has been described herein with reference to certain preferred embodiments, those embodiments have been presented by way of example only, and not to limit the scope of the invention. Additional embodiments thereof will be obvious to those skilled in the art having the benefit of this detailed description. For example, in one embodiment it might be desirable to include a switch for selecting any one of the first, the second and the third battery sources to provide power to any one of the first, the second, and the third bulbs, although such an option adds a certain level of complexity and ability for failure not present in a flashlight having, in essence, three different flashlights, each of which has its own separate and redundant features. Similarly, while it is especially preferred to use multiple battery compartments, a single compartment with three sets of electrical contacts could also be used, although such an embodiment is less preferred because a battery leak in one compartment could compromise all three flashlight modalities.

Accordingly, it will be apparent to those skilled in the art that still further changes and modifications in the actual concepts described herein can readily be made without departing from the spirit and scope of the disclosed inventions.

What is claimed is:

1. A flashlight, comprising:

a case that houses a first electrical system activated by a first on/off switch to provide power to a first bulb, a second electrical system activated by a second on/off switch to provide power to a second bulb, and a third electrical system activated by a third on/off switch to provide power to a third bulb; and a first battery source held in a first battery compartment, a second battery source held in a second battery compartment, and a third battery source held in a third battery compartment;

wherein each of the first, the second and the third battery sources provides power to one of the first, the second and the third electrical systems;

wherein each of the first, the second and the third electrical systems is powered independently of the other two electrical systems; and wherein each of the first, the second and the third bulbs has a characteristic lighting profile different than that of the other two.

2. The flashlight of claim 1, wherein each of the first, the second and the third battery sources can be removed from its battery compartment and placed in any of the first, the second and the third battery compartments.

3. The flashlight of claim 2, wherein the first battery compartment, the second battery compartment and the third battery compartment comprise a single battery compartment with a first, a second and a third set of electrical leads for providing power to the first, the second, and the third electrical systems.

4. The flashlight of claim 1, further comprising a switch for selecting any one of the first, the second and the third battery sources to provide power to any one of the first, the second, and the third bulbs.

5. The flashlight of claim 1, further comprising a multi-mode function switch for operating at least one of the first, the second and the third bulbs in two or more different lighting modes.

6. The flashlight of claim 5, wherein the two or more different lighting modes are selected from the group consisting of a dim mode, a bright mode and a blinking mode.

7. The flashlight of claim 1, further comprising a signaling means for providing a signaling color to at least one of the first, the second and third bulbs.

8. The flashlight of claim 7, wherein the signaling color is selected from the group consisting of green and red.

9. The flashlight of claim 7, wherein the signaling means is comprised of one or more colored lenses that can be positioned to change a light beam emanating from the at least one of the first, the second and the third bulbs.

10. The flashlight of claim 1, wherein the case is waterproof.

11. The flashlight of claim 10, wherein the case is explosion-proof.

12. The flashlight of claim 1, further comprising a compass built into the case.

13. The flashlight of claim 1, wherein the case is formed with a plurality of finger grips.

14. The flashlight of claim 13, wherein the case includes a non-slip surface for gripping the flashlight.

15. The flashlight of claim 1, wherein the case includes a sleeve for holding a removable insert.

16. The flashlight of claim 1, wherein the case includes a radiation stamp held in a case from which the radiation stamp can be removed.

* * * * *